US007629929B2

(12) United States Patent
Son et al.

(10) Patent No.: US 7,629,929 B2
(45) Date of Patent: Dec. 8, 2009

(54) ANTENNA USING PROXIMITY-COUPLED FEED METHOD, RFID TAG HAVING THE SAME, AND ANTENNA IMPEDANCE MATCHING METHOD THEREOF

(75) Inventors: Hae-Won Son, Daejon (KR); Won-Kyu Choi, Daejon (KR); Chan-Soo Shin, Daejon (KR); Gil-Young Choi, Daejon (KR); Cheol-Sig Pyo, Daejon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 388 days.

(21) Appl. No.: 11/526,457

(22) Filed: Sep. 25, 2006

(65) Prior Publication Data

US 2007/0080867 A1 Apr. 12, 2007

(30) Foreign Application Priority Data

Sep. 26, 2005 (KR) ..... 10-2005-0089522
Mar. 16, 2006 (KR) ..... 10-2006-0024514

(51) Int. Cl.
*H01Q 1/38* (2006.01)

(52) U.S. Cl. ..... 343/700 MS

(58) Field of Classification Search ..... 343/700 MS, 343/702, 824–826, 850, 893
See application file for complete search history.

(56) References Cited

U.S. PATENT DOCUMENTS 5,146,232 A 9/1992 Nishikawa et al.
5,510,803 A * 4/1996 Ishizaka et al. ..... 343/700 MS
5,572,222 A * 11/1996 Mailandt et al. ..... 343/700 MS
6,097,347 A 8/2000 Duan et al.
6,133,878 A * 10/2000 Lee ..... 343/700 MS
6,744,409 B2 6/2004 Ellis et al.
6,879,290 B1 * 4/2005 Toutain et al. ..... 343/700 MS
7,167,129 B1 * 1/2007 Strassner, II ..... 343/700 MS
2002/0089452 A1 * 7/2002 Lovestead ..... 343/700 MS
2003/0151550 A1 * 8/2003 Chen et al. ..... 342/372

FOREIGN PATENT DOCUMENTS

JP 04-369901 A 12/1992
JP 10-098331 A 4/1998
KR 1020000012767 A 3/2000
KR 1020010088495 A 9/2001

OTHER PUBLICATIONS

"Increasing the Bandwidth of a Microstrip Antenna by Proximity Coupling". D.M. Pozar. Electonics Letter Apr. 9, 1987. vol. 23, No. 8. pp. 368-369.

* cited by examiner

*Primary Examiner*—Huedung Mancuso
(74) *Attorney, Agent, or Firm*—Ladas & Parry LLP

(57) ABSTRACT

An antenna, a RFID tag using the same, and an antenna impedance matching method thereof are provided. The antenna includes: a radiation patch for deciding a resonant frequency of the antenna; a ground plate disposed in parallel to the radiation patch; and a feeder disposed between the radiation patch and the ground plate in parallel for providing a RF signal to an element connected to the antenna, wherein the feeder includes a microstrip feed line proximately coupled to the radiation patch by being formed perpendicularly to the resonant length direction of the radiation patch.

43 Claims, 3 Drawing Sheets

ANTENNA USING PROXIMITY-COUPLED FEED METHOD, RFID TAG HAVING THE SAME, AND ANTENNA IMPEDANCE MATCHING METHOD THEREOF

FIELD OF THE INVENTION

The present invention relates to an antenna, an RFID tag, and an impedance matching method; and, more particularly, to an antenna using a proximity-coupled feed method, a radio frequency identification (RFID) tag or transponder using the same, and an antenna impedance matching method thereof.

DESCRIPTION OF RELATED ARTS

A radio frequency identification (RFID) tag is widely used with a RFID reader or a RFID interrogator in various fields such as materials management and security management. Generally, if an object with an RFID tag attached is placed in the read zone of a RFID reader, the RFID reader transmits an interrogation signal to the RFID tag by modulating a radio frequency (RF) signal having a predetermined carrier frequency, and the RFID tag responses the interrogation signal transmitted from the RFID reader. That is, the RFID reader transmits the interrogating signal to the RFID tag by modulating a continuous electromagnetic wave having a predetermined frequency. Then, the RFID tag modulates the electromagnetic wave transmitted from the RFID reader using a back-scattering modulation scheme and returns the back-scattering modulated electromagnetic wave to the RFID reader in order to transmit the information stored in an internal memory of the RF tag to the RFID reader. The back-scattering modulation is a method of transmitting the information of a RFID tag by scattering the electromagnetic wave transmitted from the RFID reader, modulating the intensity or the phase of the scattered electromagnetic wave and transmitting the information of the RFID tag to the RFID reader.

A passive RFID tag uses the electromagnetic wave transmitted from the RFID reader as a power source of itself by rectifying the electromagnetic wave in order to obtain the driving power. In order to normally drive the passive RFID tag, the intensity of the electromagnetic wave transmitted from the RFID reader must be stronger than a predetermined threshold value at a location where the RFID tag is placed. That is, the read zone of the RFID reader is limited by the intensity of the electromagnetic wave that is transmitted from the RFID reader and reached at the RFID tag. However, the transmitting power of the RFID reader cannot increase unlimitedly because the transmitting power of the RFID reader is restricted by the local regulation of each country such as federal communication commission (FCC) of U.S. Therefore, in order to widen the read zone without increasing the transmitting power of the RFID reader, the RFID tag must effectively receive the electromagnetic wave transmitted from the RFID reader.

As one of conventional methods for improving the efficiency of the RFID tag, a method using an additional matching circuit was introduced. Generally, the RFID tag includes an antenna, a RF front-end, and a signal processor. The RF front-end and the signal processor are manufactured in one chip. The conventional method using the matching circuit maximizes the intensity of the signal transmitted from the antenna to the RF front-end by performing conjugate-matching of the antenna and the RF front-end using the additional matching circuit. However, the additional matching circuit occupies the large area in the chip because the matching circuit consists of capacitors and inductors. Therefore, the conventional method using the additional matching circuit has a drawback in the views of integrity and a manufacturing cost.

SUMMARY OF THE INVENTION

It is, therefore, an object of the present invention to provide an antenna having a broadband characteristic for unlimitedly and independently controlling the resistance components and the reactance components thereof by disposing a microstrip feed line between a radiation patch and a ground plate to be perpendicular to the resonant length direction of the radiation patch so as to be proximity-coupled to the radiation patch.

It is another object of the present invention to provide a radio frequency identification (RFID) tag that allows effective broadband matching to a RF front-end having a large capacitance reactance against resistance through the antenna.

In accordance with an aspect of the present invention, there is provided an antenna including: a radiation patch for deciding a resonant frequency of the antenna; a ground plate disposed in parallel to the radiation patch; and a feeder disposed between the radiation patch and the ground plate in parallel for providing a RF signal to an element connected to the antenna, wherein the feeder includes a microstrip feed line proximately coupled to the radiation patch by being formed perpendicularly to the resonant length direction of the radiation patch.

In accordance with another aspect of the present invention, there is also provided a method of matching the impedance of the antenna an antenna including: a radiation patch for deciding a resonant frequency of the antenna; a ground plate disposed in parallel to the radiation patch; and a feeder disposed between the radiation patch and the ground plate in parallel for providing a RF signal to an element connected to the antenna, wherein the feeder includes a microstrip feed line proximately coupled to the grand plate by being formed perpendicularly to the resonant length direction of the radiation patch.

In accordance with yet another aspect of the present invention, there is provided a radio frequency identification (RFID) tag including: an antenna for receiving a radio frequency (RF) signal transmitted from a RFID reader; a front-end for rectifying and detecting the RF signal; and a signal processor connected to the RF front-end, wherein the antenna includes: a radiation patch for deciding a resonant frequency of the antenna; a ground plate disposed in parallel to the radiation patch; and a feeder disposed for providing a RF signal to the RF front-end through a microstrip feed line proximately coupled to the radiation patch by being formed perpendicularly to the resonant length direction of the radiation patch.

In accordance with still another aspect of the present invention, there is provided an impedance matching method for an antenna having a radiation patch for deciding a resonant frequency of the antenna, a ground plate disposed in parallel to the radiation patch, and a microstrip feed line proximately connected to the radiation patch by being disposed between the radiation patch and the ground plate to be perpendicular to the resonant length direction of the radiation patch, the method including the step of: matching impedance using a characteristic that a real number part of an antenna impendence varies according to a location of the feed line in the resonant length direction of the radiation patch.

BRIEF DESCRIPTION OF THE DRAWINGS

The above and other objects and features of the present invention will become better understood with regard to the following description of the preferred embodiments given in conjunction with the accompanying drawings, in which.

DETAILED DESCRIPTION OF THE INVENTION

Hereinafter, an antenna, a RFID tag using the same, an antenna impedance matching method thereof in accordance with a preferred embodiment of the present invention will be described in more detail with reference to the accompanying drawings.

Figure 1:
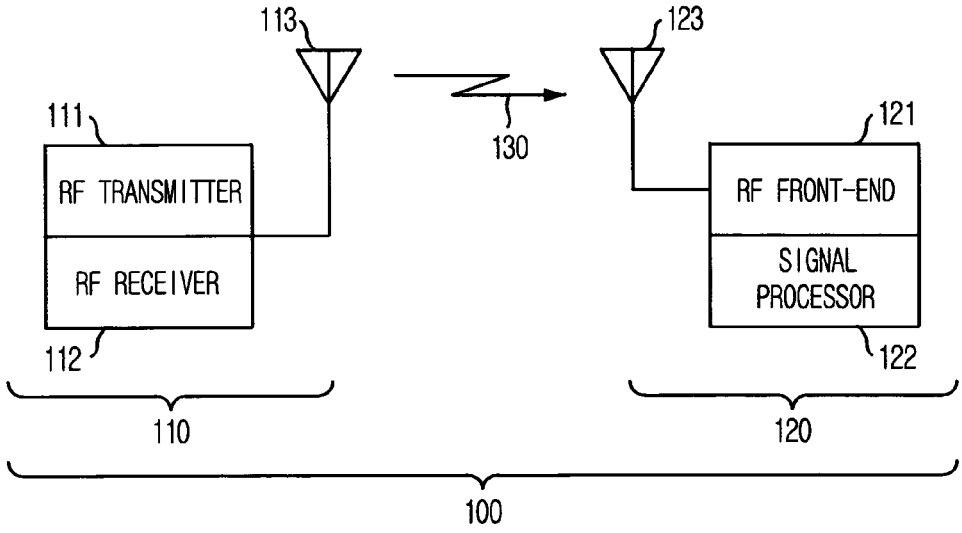
FIG. 1 is a block diagram of a RFID system 100 where the present invention is applied.

FIG. 1 is a block diagram of a RFID system 100 where the present invention is applied.

Referring to FIG. 1, the RFID system 100 includes a RFID tag 120 for storing information thereof, a RFID reader 110 having an analyzing and a decoding function, and a host computer (not shown) for reading data from the RFID tag 120 through the RFID reader 110 and processing the read data.

The RFID reader 110 includes a RF transmitter 111, a RF receiver 112, and a reader antenna 113. The reader antenna 113 is electrically connected to the RF transmitter 111 and the RF receiver 112. The RFID reader 110 transmits a RF signal to the RFID tag 120 through the RF transmitter 111 and the reader antenna 113. The RFID reader 110 receives a RF signal from the RFID tag 120 through the reader antenna 113 and the RF receiver 112. As introduced in U.S. Pat. No. 4,656,463, the structure of the RFID reader 110 is well known to those skilled in the art. Therefore, the detailed description thereof is omitted.

The RFID tag 120 includes a RF front-end 121, a signal processor 122 and a tag antenna 123 in accordance with an embodiment of the present invention. In case of a passive RFID tag, the RF front-end 121 supplies a necessary power to the signal processor 122 by transforming a received RF signal to a DC voltage. Also, the front-end 121 extracts a baseband signal from the received RF signal. As introduced in U.S. Pat. No. 6,028,564, the constitution of the RF front-end is well known to those skilled in the art. Therefore, detail description thereof is omitted. The signal processor 122 also has a widely known constitution to those skilled in the art as introduced in U.S. Pat. No. 5,942,987.

Hereinafter, the operations of the RFID system 100 will be described. The RFID reader 110 sends an interrogation signal to the RFID tag 120 by modulating a RF signal with a predetermined carrier frequency. The RF signal created from the RF transmitter 111 of the RFID reader 110 is externally transmitted through an antenna 113 as the form of an electromagnetic wave. Then, the electromagnetic wave 130 is transmitted from the reader antenna 113 to the tag antenna 123. The tag antenna 123 transfers the received electromagnetic wave 130 to the RF front-end 121. If the intensity of the RF signal transferred to the RF front-end 121 is stronger than a minimum requested power to drive the RFID tag 120, the RFID tag 120 reposes to the interrogation signal transmitted from the RFID reader 110 by modulating the electromagnetic wave 130 using the back-scattering modulation.

In order to widen the read zone of the RFID reader 110, the intensity of the electromagnetic wave 130 transmitted from the RFID reader 110 must be strong enough to provide a driving power to the RFID tag 120. Also, the electromagnetic wave 130 transmitted from the RFID reader 110 must be transferred to the RF front-end 131 without any loss using the high efficient tag antenna 123. That is, in order to provide the high efficiency to the tag antenna 123, the carrier frequency of the RF reader 110 must have a resonant characteristic and must be conjugate-matched with the RF front-end 121.

Figure 2:
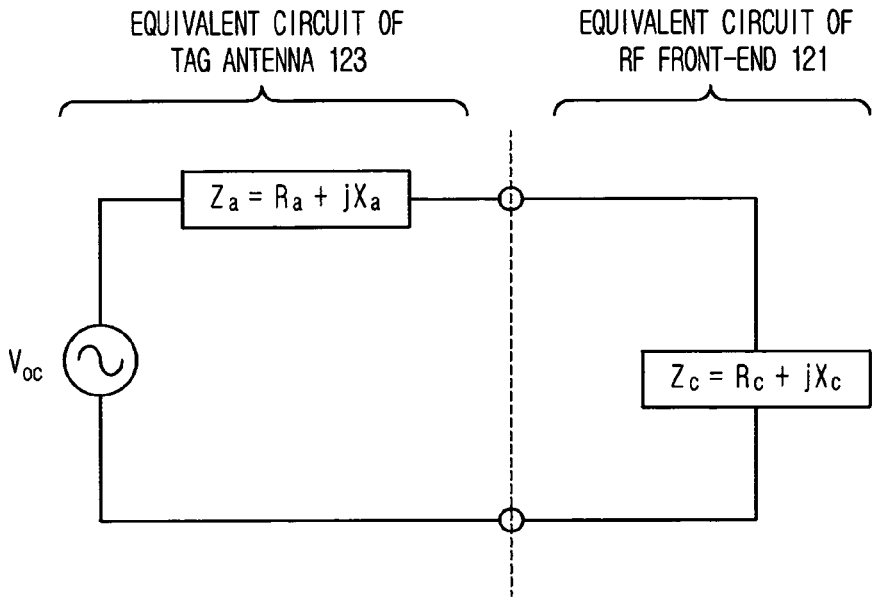
FIG. 2 is an equivalent circuit diagram of the tag antenna 123 and the RF front end 121 of FIG. 1.

FIG. 2 is an equivalent circuit diagram of the tag antenna 123 and the RF front end 121 of FIG. 1. The circuit includes a voltage source $V_\alpha$, an antenna impedance $Z_a$ and a RF front-end impedance $Z_c$. The voltage source $V_\alpha$ and the antenna impedance $Z_a$ are the equivalent circuit of the tag antenna 123. The RF front-end impedance $Z_c$ is the equivalent circuit of the RF front-end 121. The antenna impedance has a real number part $R_a$ and an imaginary number part $X_a$. The real number part $R_a$ denotes the equivalent resistance of the tag antenna 123, and the imaginary number part $X_a$ denotes the equivalent reactance of the tag antenna 123. The RF front-end impedance also has a real number part $R_c$ and an imaginary number part $X_c$. The real number part $R_c$ denotes the equivalent resistance of the RF front-end 121, and the imaginary number part $X_c$ denotes the equivalent reactance of the RF front-end 121.

In general, the maximum power is transferred from the tag antenna 123 to the RF front-end 121 if the antenna impedance $Z_a$ and the RF front-end impedance $Z_c$ are conjugate-matched. The conjugate matching is to make two complex impedances to have the same absolute impedance value and to have the opposite phases. That is, if the impedance of the tag antenna 123 or the impedance of the RF front-end 121 is controlled to be $R_a=R_c$, and $X_a=-X_c$, the maximum power is transferred from the tag antenna 123 to the RF front-end 121.

Generally, the RF front-end 121 of a passive or a semi-passive RFID tag includes a rectifier circuit and a detector circuit using a diode and does not include an additional matching circuit in order to reduce the size of the chip thereof. Therefore, the impedance of the RF front-end 121 has a complex impedance different from about 50Ω in general. Also, the impedance of the RF front-end 121 has a small resistance component $R_c$ and a large capacitive reactance component $X_c$ in a ultra high frequency (UHF) band due to the characteristics of the rectifier and the detector circuit. Therefore, the antenna impedance $Z_a$ for the conjugate matching must have a small resistance component $R_a$ and a large inductive reactance component $X_a$, and they must be resonated by the frequency of the electromagnetic wave transmitted from the RFID reader at the same time.

Figure 3:
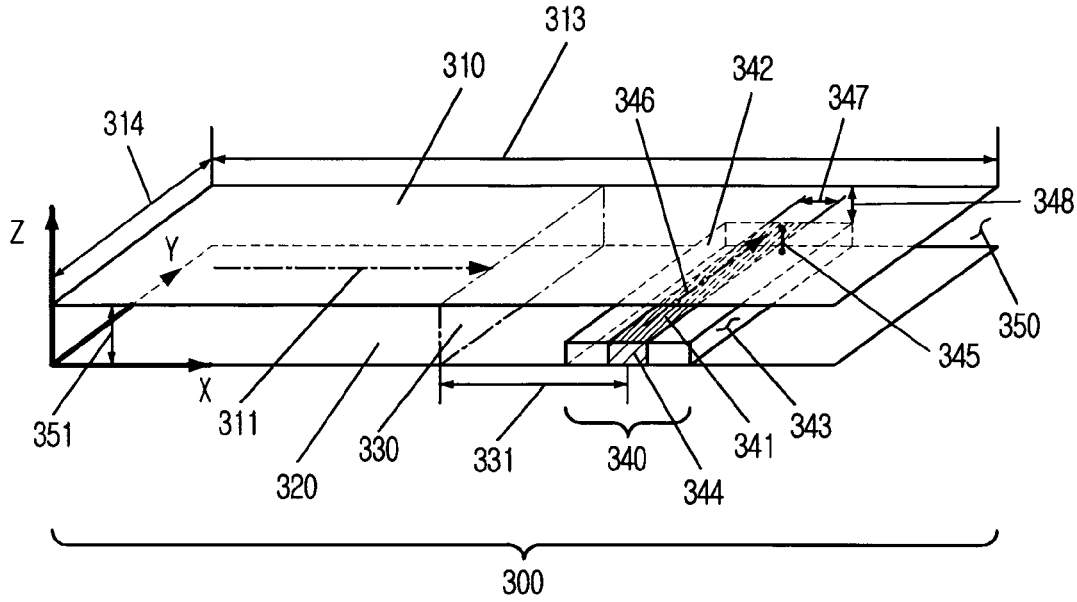
FIG. 3 is a view illustrating a tag antenna 300 in accordance with a first embodiment of the present invention.

FIG. 3 is a view illustrating a tag antenna 300 in accordance with a first embodiment of the present invention.

Referring to FIG. 3, the tag antenna 300 according to the present embodiment includes a rectangular radiation patch 310 and a ground plate 320 disposed to be parallel from the radiation patch 310. The radiation patch 310 is proximity-coupled to a microstrip feed line 341. The direction 346 of the microstrip feed line 341 is perpendicular to the resonant length direction 311 of the radiation patch 310. That is, as shown in FIG. 3, if the resonant length direction of the radiation patch 310 is a direction x, the direction 346 of the feed line 341 is controlled to be in a direction y. The radiation patch 310 and the ground plate 320 are separated each other at a constant distance 351 in parallel, and the predetermined portion or the entire of the radiation patch 310 and the ground plate 320 are filled with a predetermined dielectric material 350 including air. The resonant frequency of the tag antenna 300 is decided by the length 313 of the radiation patch 310. The width 314 of the radiation patch 310 lightly influences the resonant frequency, comparatively. Generally, the resonant frequency of the antenna becomes little bit smaller if the width 314 of the radiation patch 310 becomes wider.

In a conventional proximity coupled feed method, the direction of the feed line is formed to be identical to the resonant length of the radiation patch. Such a conventional proximity coupled feed method is described in an article by D. M. Pozar, entitled "Increasing the bandwidth of a microstrip antenna by proximity coupling", Electronics Letters, vol. 23, No. 8, April 1987. In the conventional proximity coupled feed method, the equivalent impedance between the radiation patch and the ground plate which are coupled to the feed line significantly vary according to the coupling location on the feed line. Therefore, the resistance component $R_a$ and the reactance component $X_a$ of the antenna cannot be independently controlled. Also, it is very difficult to make a small resistance component $R_a$ as small as about several Ωs, which is required to a RFID tag antenna, using the conventional proximity coupled feed method.

In the antenna according to the present embodiment, the direction 346 of the feed line is disposed perpendicular to the resonant length direction 311 of the radiation patch. In this case, the equivalent impedance between the radiation patch and the ground patch coupled to the feed line is not significantly varied according to the coupling location thereof on the feed line. Therefore, the resistance component $R_a$ and the reactance components $X_a$ of the antenna can be controlled independently and unlimitedly. Also, it is possible to easily make the small resistance component $R_a$ as small as about server Ωs, which is required at the RFID tag antenna. For example, when the resonate length direction 311 of the radiation patch 310 has a symmetry structure with a center surface 330 as a central figure, the equivalent impedance between the radiation patch 310 and the ground plate 320 from the center surface 330 becomes about 0Ω. Therefore, the closer the feed line 341 is to the center surface 330, the smaller the equivalent impedance coupled to the feed line 341 can be obtained. By controlling the coupling location of the feed line 341 as described above, it is easy to manufacture the antenna having a small resistance component $R_a$ as small as several Ωs. Also, the antenna according to the present embodiment has a broadband characteristic like as a conventional antenna using a conventional proximity coupled feed method.

As shown in FIG. 3, the feeder 340 of the antenna according to the present embodiment includes a dielectric plate 342, a feed line 341 disposed at one side of the dielectric plate 342 and having a form of a microstrip, and a ground side 343 disposed at the opposite side from the side coupled to the dielectric plate 342. The feeder 340 is disposed between the radiation patch 310 and the ground plate 320, and the ground side 343 of the feeder 340 is shorted from the ground plate 340 in a direct current (DC), or in an alternating current (AC) through a capacitive coupling. Also, the ground plate 320 may be shared as the ground side 343 of the feeder 340. That is, the one metal plate can be used as the ground plate and the ground side at the same time.

A terminal 344 is formed on a one end of the feeder 341, and the terminal 344 is connected to the RF front-end 121. A load 345 having a predetermined value is formed at other end of the feed line 341. Herein, the load 345 may be opened or shorted, or it is obvious to those skilled in the art that various shapes of well-known loads may be used as the load 345 such as a lumped element and a distributed element.

When the antenna 300 according to the present embodiment is resonated, the equivalent impedance between the radiation patch 310 and the ground plate 320 at the location of the feed line 341 mainly has resistance component, and the resistance component is added to the feed line 341 through the capacitive coupling. The amount of the capacitive coupling is decided by the coupling capacitance between the feed line 341 and the radiation patch 310. In FIG. 3, the amount of the coupling capacitance and the distance from the center surface 330 of the radiation patch 310 to the feed line 341 are major factors to decide the resistance component $R_a$ of the entire antenna impedance. Generally, the longer the distance between the center surface 330 and the feed line 341 is, the larger the resistance component $R_a$ of the antenna impedance becomes. Also, the larger the coupling capacitance between the feed line 341 and the radiation patch 310 becomes, the larger the resistance component $R_a$ of the antenna impedance becomes. The coupling capacitance is decided by the line width 347 of the feed line, and the distance 348 between the feed line and the radiation patch. Meanwhile, the reactance component $X_a$ of the antenna impedance is decided mainly by the characteristic impedance of the feed line 341, the value of the load 345, the length of the feed line 341 from the load 345 to the feed terminal 344.

Therefore, the antenna according to the present invention allows the reactance $X_a$ of the antenna impedance to be controlled by controlling the characteristics impedance of the feed line 341, the length of the feed line and the load 345. Also, the antenna according to the present invention allows the resistance component $R_a$ of the antenna impedance to be controlled by controlling the location of the feed line in the resonant length direction of the radiation patch, and by the coupling capacitance between the feed line and the radiation patch. That is, it is possible to achieve the effectively impedance matching to the RF front-end 121 that has predetermined impedance because the antenna according to the present embodiment allows the resistance component $R_a$ and the reactance component $X_a$ of the antenna impedance to be controlled independently and unlimitedly.

Meanwhile, the length 313 of the radiation patch is decided for the radiation patch 310 to have a resonant characteristic in an operating frequency. It is obvious to those skilled in the art that the length of the radiation patch can be reduced by about ½, while the resonant frequency is sustained identically, by disposing a shorting plate or a sequence of shorting pins between the radiation patch 310 and the ground plate 320.

Figure 4:
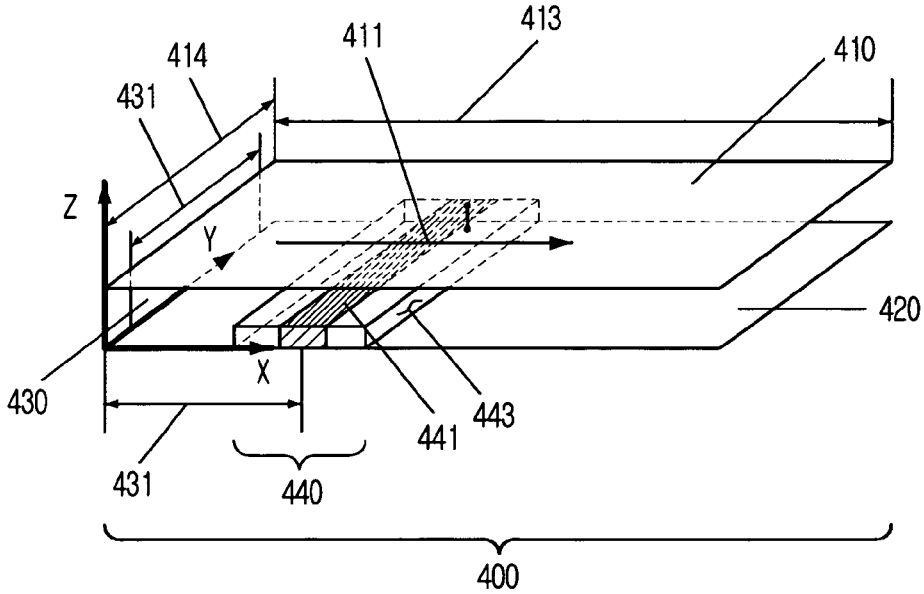
FIG. 4 is a view of a tag antenna 400 using a proximity coupled feed method in accordance with a second embodiment of the present invention.

FIG. 4 is a view of a tag antenna 400 using a proximity coupled feed method in accordance with a second embodiment of the present invention.

Referring to FIG. 4, the tag antenna 400 according to the second embodiment includes a radiation patch 410, a ground plate 420 and a shorting plate 430. In the tag antenna 400 according to the second embodiment, the length of the radiation patch 413 is reduced by shorting the radiation patch 410 and the ground late 430 through disposing the shorting plate 430 between the radiation patch 410 and the ground plate 420. The shorting plate 430 is disposed in a perpendicular direction, which is a direction y, form the resonant length direction 411 of the radiation patch 410 at one side corner of the radiation patch 410. The width 431 of the shorting plate may be different from the width 414 of the radiation patch. As shown in FIG. 4, the equivalent impedance between the radiation patch 410 and the ground plate 420 becomes about 0Ω. Therefore, the resistance component $R_a$ of the antenna impedance is decided by the coupling capacitance between the radiation patch 410 and the feed line 441, and by the distance 431 between the shorting plate 430 and the feed line 431.

Figure 5:
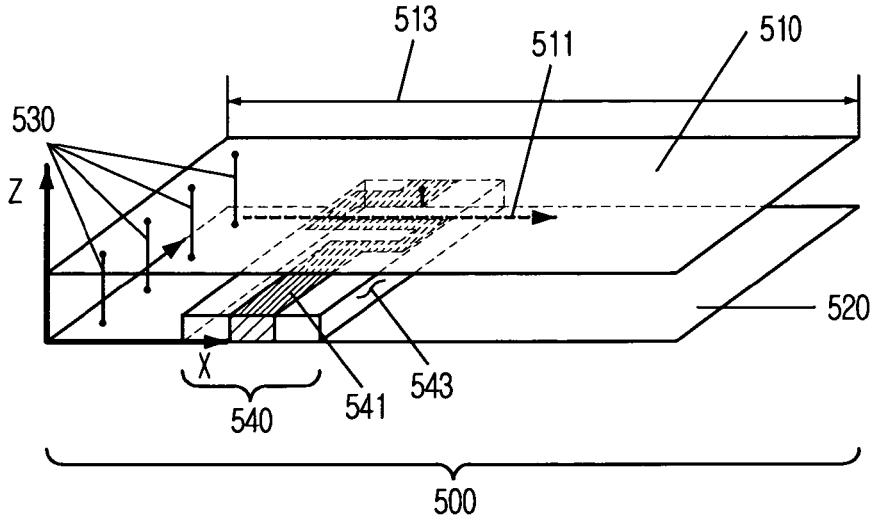
FIG. 5 is a view showing a tag antenna 500 using a proximity coupled feed method in accordance with a third embodiment of the present invention.

FIG. 5 is a view showing a tag antenna 500 using a proximity coupled feed method in accordance with a third embodiment of the present invention. The tag antenna 500 according to the third embodiment includes a radiation patch 510, a ground plate 520 and a plurality of shorting pins 530. In the tag antenna 500 according to the third embodiment, the length of the radiation patch is reduced by shorting the radiation patch 510 and the ground plate 520 by disposing a sequence of the shorting pins 530 between the radiation patch 510 and the ground plate 520. The shorting pins 530 are disposed to be perpendicularly from the resonant length direction 511 of the radiation patch 510 at one side corner of the radiation patch 510. As shown in FIG. 5, the equivalent impedance between the radiation patch 510 and the ground plate 520 at the disposing location of the shorting pins becomes about 0Ω. Therefore, the resistance component $R_a$ of the antenna impedance is decided by the coupling capacitance between the radiation patch 510 and the feed line 541, and by the distance 431 between the location of the shorting pins 530 and the feed line 531 in FIG. 5.

As shown in FIG. 5, the feed line 541 has a meander structure although the feed lines 341 and 441 have a shape of a straight line in FIGS. 3 and 4. In order to reduce the size of the feed line, it is obvious to those skilled in the art that the feed line may have a meander structure as shown in FIG. 5 or the feed line may be manufactured to have various shapes.

Also, it is obvious to those skilled in the art that the size of the feeder may be reduced by forming a slot at the radiation patch or increasing relative dielectric constant of the dielectric filling between the radiation patch and the ground plate.

Figure 6:
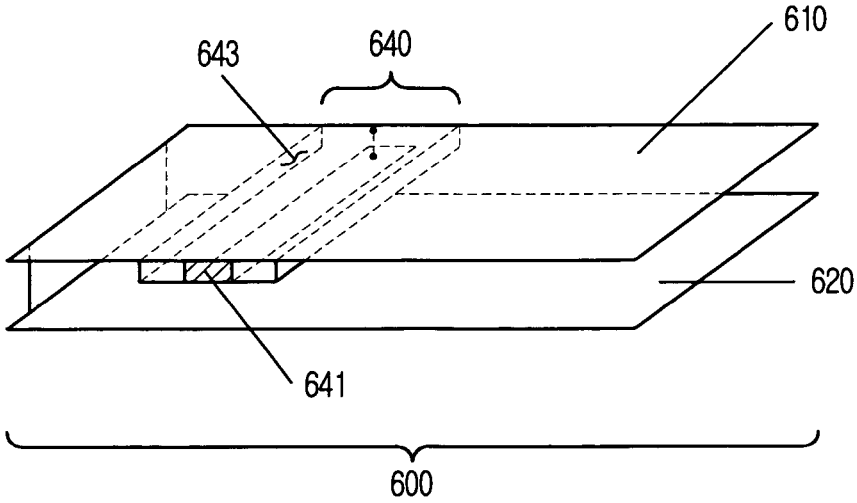
FIG. 6 is a view showing a tag antenna 600 using a proximity coupled feed method in accordance with a fourth embodiment of the present invention.

FIG. 6 is a view showing a tag antenna 600 using a proximity coupled feed method in accordance with a fourth embodiment of the present invention. Unlike from the other antennas shown in FIGS. 3 to 5, the ground side of the feeder 640 is shorted from the radiation patch 610 in a DC manner, or shorted through the capacitive coupling in an AC manner in the tag antenna 600 of FIG. 6. Also, the radiation patch 610 may be shared as the ground side of the feeder. As shown in FIG. 6, the ground plate 620 is proximity-coupled to the feed line 641. The operations and the effects of the present invention described with reference to FIGS. 3 to 5 are identically applied into the tag antenna 600 of FIG. 6.

As described above, the microstrip feed line is disposed between the radiation patch and the ground plate to be perpendicular from the resonant length direction of the radiation patch so as to be proximity coupled to the radiation patch in the antenna according to the present invention. Therefore, the resistance component and the reactance component of the antenna impedance can be controlled independently and unlimitedly according to the present invention.

Therefore, it is an object of the present invention to a low cost planner antenna capable of an effective broadband matching to an antenna coupling element having a predetermined impedance using a proximity-coupled feed method. Also, it is another object of the present invention to provide an antenna capable of an effective broadband matching to a RF front-end having a large capacitive reactance against the resistance, and a RFID tag using the same.

The antenna using the proximity-coupled feed method and the RFID tag using the same have the resonant characteristic and the broadband characteristics and also provides superior characteristics even when the antenna is attached to a metal surface or a material having a high dielectric constant.

It is still another object of the present invention to provide an antenna impedance matching method using a proximity-coupled feed method.

The present application contains subject matter related to Korean patent application Nos. KR 2005-0089522 and 2006-0024514, filed with the Korean patent office on Nov. 26, 2005, and Mar. 16, 2006, the entire contents of which being incorporated herein by reference.

While the present invention has been described with respect to certain preferred embodiments, it will be apparent to those skilled in the art that various changes and modifications may be made without departing from the spirits and scope of the invention as defined in the following claims.

What is claimed is:

1. An antenna, comprising:

a radiation patch for deciding a resonant frequency of the antenna;

a ground plate disposed in parallel to the radiation patch; and a feeder disposed between the radiation patch and the ground plate in parallel for providing a RF signal to an element connected to the antenna, wherein the feeder includes:

a microstrip feed line proximately coupled to the radiation patch by being formed perpendicularly to the resonant length direction of the radiation patch and a ground side disposed to be separated in the ground plate direction from the feed line in parallel wherein the ground side of the feeder is shorted from the ground plate in a direct current (DC) manner.

2. The antenna as recited in claim 1, wherein the feeder further includes:

a dielectric substrate disposed between the radiation patch and the ground plate.

3. The antenna as recited in claim 1, wherein the ground plate is used as the ground side of the feeder.

4. The antenna as recited in claim 1, wherein a terminal for connecting the element connected to the antenna is formed on one end of the feed line.

5. The antenna as recited in claim 4, wherein the other end of the feed line is opened or shorted.

6. The antenna as recited in claim 4, wherein a load is connected to the other end of the feed line.

7. The antenna as recited in claim 6, wherein the load is a lumped element or a distributed element.

8. The antenna as recited in claim 1, further comprising a shorting means for shorting the radiation patch and the ground plate.

9. The antenna as recited in claim 8, wherein the shorting means is a shorting plate or a shorting pin.

10. The antenna as recited in claim 1, wherein the feed line has a meander structure.

11. The antenna as recited in claim 1, wherein a slot is formed at the radiation patch.

12. The antenna as recited in claim 2, wherein the space between the radiation patch and the ground plate is completely filled with the dielectric substrate.

13. The antenna as recited in claim 6, wherein the impedance of the antenna is controlled using a characteristic that an imaginary number part of the antenna impedance varies according to an impedance of the load.

14. An antenna, comprising:

a radiation patch for deciding a resonant frequency of the antenna;

a ground plate disposed in parallel to the radiation patch; and a feeder disposed between the radiation patch and the ground plate in parallel for providing a RF signal to an element connected to the antenna, wherein the feeder includes:

a microstrip feed line proximately coupled to the radiation patch by being formed perpendicularly to the resonant length direction of the radiation patch, and a ground side disposed to be separated in the ground plate direction from the feed line in parallel, wherein the ground side of the feeder is shorted from the ground plate in an alternating current (AC) manner through a capacitive coupling.

15. The antenna as recited in claim 14, wherein the feeder further includes: a dielectric substrate disposed between the radiation patch and the ground plate.

16. The antenna as recited in claim 14, wherein the ground plate is used as the ground side of the feeder.

17. The antenna as recited in claim 14, wherein a terminal for connecting the element connected to the antenna is formed on one end of the feed line.

18. The antenna as recited in claim 17, wherein the other end of the feed line is opened or shorted.

19. The antenna as recited in claim 17, wherein a load is connected to the other end of the feed line.

20. The antenna as recited in claim 19, wherein the load is a lumped element or a distributed element.

21. The antenna as recited in claim 14, further comprising a shorting means for shorting the radiation patch and the ground plate.

22. The antenna as recited in claim 21, wherein the shorting means is a shorting plate or a shorting pin.

23. The antenna as recited in claim 14, wherein the feed line has a meander structure.

24. The antenna as recited in claim 14, wherein a slot is formed at the radiation patch.

25. The antenna as recited in claim 15, wherein the space between the radiation patch and the ground plate is filled with the dielectric substrate.

26. The antenna as recited in claim 19, wherein the impedance of the antenna is controlled using a characteristic that a real number part of the antenna impedance varies according to an impedance of the load.

27. An antenna, comprising:

a radiation patch for deciding a resonant frequency of the antenna;

a ground plate disposed in parallel to the radiation patch; and a feeder disposed between the radiation patch and the ground plate in parallel for providing a RF signal to an element connected to the antenna, wherein the feeder includes a microstrip feed line proximately coupled to the radiation patch by being formed perpendicularly to the resonant length direction of the radiation patch, and wherein the impedance of the antenna is controlled using a characteristic that a real number part of antenna impedance varies according to a coupling capacitance between the radiation patch and the feed line where the coupling capacitance decides a coupling amount of the feed line and an equivalent impedance between the radiation patch and the ground plate.

28. The antenna as recited in claim 27, wherein the impedance of the antenna is controlled using the characteristic that the real number part of the antenna impedance increases as the coupling capacitance increases.

29. The antenna as recited in claim 27, wherein the impedance of the antenna is controlled using a characteristic that the coupling capacitance increases as the width of the feed line is widened.

30. The antenna as recited in claim 27, wherein the impedance of the antenna is controlled using a characteristic that the coupling capacitance increases as a distance between the radiation patch and the feed line is reduced.

31. The antenna as recited in claim 27, wherein the impedance of the antenna is controlled using the characteristic that the real number part of the antenna impedance changes according to a distance from a center of the resonant length direction of the radiation patch to the feed line.

32. The antenna as recited in claim 31, wherein the impedance of the antenna is controlled using a characteristic that the real number part of the antenna impedance increases as a distance from a center of the resonant length direction of the radiation patch to the feed line increases.

33. The antenna as recited in claim 31, wherein the impedance of the antenna is controlled using a characteristic that the real number part of the antenna impedance varies according to a distance from the shorting means to the feed line.

34. The antenna as recited in claim 33, wherein the impedance of the antenna is controlled using a characteristic that the real number part of the antenna impedance increases as a distance from the shorting means to the feed line increases.

35. An antenna, comprising:

a radiation patch for deciding a resonant frequency of the antenna;

a ground plate disposed in parallel to the radiation patch; and a feeder disposed between the radiation patch and the ground plate in parallel for providing a RF signal to an element connected to the antenna, wherein the feeder includes a microstrip feed line proximately coupled to the radiation patch by being formed perpendicularly to the resonant length direction of the radiation patch, and wherein the impedance of the antenna is controlled using a characteristic that an imaginary number part of the antenna impedance varies according to a characteristic impedance of the feed line.

36. The antenna as recited in claim 35, wherein the impedance of the antenna is controlled using a characteristic that an imaginary number part of the antenna impedance varies according to the length of the feed line.

37. The antenna as recited in claim 35, wherein the impedance of the antenna is controlled using the characteristic that the imaginary number part of the antenna impedance increases as the coupling capacitance increases.

38. The antenna as recited in claim 35, wherein the impedance of the antenna is controlled using a characteristic that the coupling capacitance increases as the width of the feed line is widened.

39. The antenna as recited in claim 35, wherein the impedance of the antenna is controlled using a characteristic that the coupling capacitance increases as a distance between the radiation patch and the feed line is reduced.

40. The antenna as recited in claim 35, wherein the impedance of the antenna is controlled using the characteristic that the imaginary number part of the antenna impedance changes according to a distance from a center of the resonant length direction of the radiation patch to the feed line.

41. The antenna as recited in claim 40, wherein the impedance of the antenna is controlled using a characteristic that the imaginary number part of the antenna impedance increases as a distance from a center of the resonant length direction of the radiation patch to the feed line increases.

42. The antenna as recited in claim 40, wherein the impedance of the antenna is controlled using a characteristic that the imaginary number part of the antenna impedance varies according to a distance from the shorting means to the feed line.

43. The antenna as recited in claim 42, wherein the impedance of the antenna is controlled using a characteristic that the imaginary number part of the antenna impedance increases as a distance from the shorting means to the feed line increases.

* * * * *